US009322218B2

(12) United States Patent
Russell et al.

(10) Patent No.: US 9,322,218 B2
(45) Date of Patent: Apr. 26, 2016

(54) BOREHOLE CUTTING ASSEMBLY FOR DIRECTIONAL CUTTING

(76) Inventors: Michael King Russell, Cheltenham (GB); Michael Andrew Yuratich, Hamble (GB)

( * ) Notice: Subject to any disclaimer, the term of this patent is extended or adjusted under 35 U.S.C. 154(b) by 979 days.

(21) Appl. No.: 13/255,883

(22) PCT Filed: Mar. 10, 2010

(86) PCT No.: PCT/GB2010/000427

§ 371 (c)(1),
(2), (4) Date: Dec. 19, 2011

(87) PCT Pub. No.: WO2010/103271

PCT Pub. Date: Sep. 16, 2010

(65) Prior Publication Data

US 2012/0118646 A1 May 17, 2012

(30) Foreign Application Priority Data

Mar. 10, 2009 (GB) ..... 0904055.1

(51) Int. Cl.
*E21B 4/02* (2006.01)
*E21B 7/06* (2006.01)

(52) U.S. Cl.
CPC . *E21B 7/068* (2013.01); *E21B 4/02* (2013.01); *E21B 7/067* (2013.01)

(58) Field of Classification Search
CPC ..... E21B 7/06; E21B 7/046; E21B 7/067; E21B 7/068; E21B 4/00; E21B 4/02; E21B 44/04; E21B 44/06; F03B 13/02
USPC ..... 175/73, 107
See application file for complete search history.

(56) References Cited

U.S. PATENT DOCUMENTS 3,841,420 A 10/1974 Russell
6,129,160 A * 10/2000 Williams et al. ..... 175/107

(Continued)

FOREIGN PATENT DOCUMENTS

GB 2363811 A 1/2002
GB 2370590 A 7/2002
GB 2373272 A 9/2002

OTHER PUBLICATIONS

International Search Report and Written Opinion of the International Searching Authority, mailed Oct. 7, 2010, for corresponding International Application No. PCT/GB2010/000427, 10 pages.

*Primary Examiner* — Robert E Fuller
*Assistant Examiner* — David Carroll
(74) *Attorney, Agent, or Firm* — Klarquist Sparkman, LLP

(57) ABSTRACT

A borehole cutting assembly for directional cutting in a borehole, the assembly comprising an input pipe and a cutting head rotatably mounted on the input pipe such that the orientation of the cutting head relative to the input pipe can be altered to determine the direction of cutting of the borehole. A cutting tool and cutting tool motor are mounted on the cutting head to enable the cutting tool to be rotatably driven relative to the cutting head so that when the cutting tool is loaded in use the cutting head is subject to a tool reaction torque that acts to rotate the cutting head to change the orientation of the cutting head. The cutting head is rotatably mounted on the input pipe by a controlled torque coupling comprising a progressive cavity pump having a rotor and a stator each provided with drive formations arranged to define a fluid flow cavity therebetween. Rotation of the rotor relative to the stator forces fluid flow through the cavity to counteract the tool reaction torque. Fluid flow control means is provided to resist the flow of fluid through the cavity in use and thus to control the magnitude of the counteraction generated by the progressive cavity pump to the tool reaction torque.

68 Claims, 7 Drawing Sheets

(56) References Cited

U.S. PATENT DOCUMENTS

| | | | | |
|---|---|---|---|---|
| 6,557,642 | B2 | 5/2003 | Head | |
| 7,510,031 | B2 | 3/2009 | Russell et al. | |
| 7,543,658 | B2 | 6/2009 | Russell et al. | |
| 8,322,461 | B2 | 12/2012 | Hay et al. | |
| 2006/0243493 | A1* | 11/2006 | El-Rayes et al. | 175/107 |
| 2008/0121432 | A1 | 5/2008 | Russell | |
| 2011/0214963 | A1* | 9/2011 | Beylotte et al. | 192/106 R |

* cited by examiner

13

19
17
11
1
P
P
RH
PCP
15
RH
PDM 19
17
11
1
P
P
LH
PCP
15
RH
PDM 19
17
11
1
P
P
LH
PCP
15
RH
PDM

BOREHOLE CUTTING ASSEMBLY FOR DIRECTIONAL CUTTING

CROSS REFERENCE TO RELATED APPLICATIONS

This is the U.S. National Stage of International Application No. PCT/GB2010/000427, filed Mar. 10, 2010, which in turn claims the benefit of and priority to Great Britain Application No. GB0904055.1, filed Mar. 10, 2009.

The present invention relates to a borehole cutting assembly for directional cutting and particularly but not exclusively relates to an assembly for cutting boreholes for oil, gas or water.

Cutting of boreholes, such as required for oil and gas exploration, and water, is conducted using an input pipe, known as a drill pipe, run from a surface rig down to the cutting tool, an example of which comprises a drill bit.

In conventional rotary drilling the drill bit is attached to the bottom of the drill pipe and caused to drill by turning the pipe from the surface. In downhole motor drilling, a positive-displacement motor (PDM) is attached to a cutting head at a lower part of the drill pipe, and its rotor is connected to the cutting tool. The PDM comprises a rotor and a stator formed with internal formations that define an internal fluid flow cavity arranged to cause relative rotation between the rotor and the stator when fluid is pumped therebetween. The fluid most typically comprises mud pumped from the surface which passes between the PDM rotor and stator which rotates the cutting tool.

In both forms of drilling the reaction of the cutting tool's cutting torque is resisted by the drill pipe.

PDMs are widely manufactured. They are commonly termed Moineau motors after the inventor, and by similar sounding trade names. A descriptive name also used is "progressive cavity motor" by virtue of its design in which a helically lobed rotor is inserted into a differently helically lobed stator so as to create a series of cavities, the helical lobes comprising the drive formations. Mud forced into the rotor—stator interface becomes trapped in a cavity defined therebetween and progresses through the motor, forcing the rotor to turn.

It is often desired to control the cutting action so as to effect a change of direction in the borehole being cut—some boreholes are eventually turned to progress horizontally for example.

In downhole motor drilling, the standard procedure for steering the direction of the borehole is to use a bent housing below the PDM. This guides the cutting tool at an angle inclined to the longitudinal axis of the PDM and drill pipe. The connection between the PDM rotor and the cutting tool can be made in a number of ways, of which one is to use a flexible shaft. Using measurements from downhole sensors, the drill pipe is first rotated at surface until the plane of the bend, that is the plane containing both the longitudinal axis of the drill pipe and the longitudinal axis of the bent housing, is pointing in the desired direction. In some cases this is performed using a downhole rotator. As cutting proceeds, the cutting tool progresses along a curved cutting trajectory, and the drill pipe follows. When it is desired to stop drilling along a curved trajectory, the drill pipe is continuously rotated so that the bent housing with cutting tool rotates about the longitudinal axis of the drill pipe and sweeps out a slightly over-sized hole, with no preferred direction, resulting in drilling ahead.

It is well known that unless the drill pipe can be rotated, it is subject to sticking and slipping and ultimately can not be made to move further into the well. This is a severe limitation on the ability to cut highly deviated holes while steering with an oriented, bent housing.

In rotary drilling, means have been found to drill in given directions while the pipe continues to rotate, and have eaten into the market for steerable downhole motor drilling.

Downhole motors have many advantageous features compared to rotary drilling. They can turn faster and so use alternative types of drill bits suited to different borehole formation properties, and they can progress faster. The motor torque has a damping effect on the torsional dynamics of the drill pipe, which are often damaging in rotary drilling. Recent advances in PDM technology have resulted in great increases in the cutting torque and this often makes them preferred to rotary drilling even in large bit sizes. Examples of PDMs commonly used range in approximate diameter from three inches to ten inches.

It is therefore highly desirable to be able to rotate the drill pipe while steering with a downhole motor, and to be able to do so with the largest and smallest motor sizes.

U.S. Pat. No. 3,841,420 discloses a principle of steerable drilling with a downhole drill motor, while the drill pipe rotates. This recognises that a controlled torque coupling inserted between drill pipe and cutting head can transmit the reaction torque to the drill pipe, whilst permitting relative rotation between the drill pipe and the cutting head—ie the controlled torque coupling enables the drill pipe to rotate whilst the cutting head remains orientated in the desired direction. This enables the well bore to be cut by the cutting tool, so that the drill pipe can progress down the wellbore without becoming stuck.

If the transmitted torque is controlled dynamically with reference to directional sensors and a desired direction, the bent housing can be held steady. In equilibrium the controlled torque coupling transmits the reaction torque exactly. If the bent housing is slightly in the wrong direction the transmitted torque is momentarily relaxed or increased to allow the bent housing to slip or advance to the correct position. In control system terms, the control loop continuously regulates the phase (angular position) of the longitudinal axis of the bent housing by varying the torque between the drill pipe and the cutting tool motor.

If the torque coupling was set to minimum or no torque, the bent housing would rotate freely backwards leaving the drill bit stuck against the formation being cut. Increasing the torque transmission between the drill pipe and motor housing would slow the bent housing down until at the control point the reaction torque is balanced and the bent housing is stationary. If the torque coupling was to increase its grip further the bent housing would start to creep forward, until ultimately if it was set so high as to lock up, the cutting tool motor and bent housing would be forced to rotate with the drill pipe. Since the controlled torque coupling permits relative motion whilst transmitting torque, it may also be termed a slipping clutch.

U.S. Pat. No. 3,841,420 recognised that a pump could be used in a hydraulic circuit with a control valve to load the pump. The stator and rotor members of the pump are used to couple the drill pipe and cutting tool motor housing. Variably loading the pump requires variable torque to force its members to turn relative to each other, and thus the system has the desired characteristics of a variable, controlled torque coupling.

U.S. Pat. No. 7,510,031 discloses a slipping clutch based on a step-up gearbox and loaded generator. The input to the gearbox is connected to the drill pipe, its housing to the drill motor housing and its output to an electromagnetic clutch referred to the drill motor housing. The clutch friction applies torque to the gearbox output. The gearbox ratio multiplies this torque to the reaction torque level at its input. By absorbing the power in a variable load varying the clutch friction, the transmitted reaction torque can be controlled.

U.S. Pat. No. 7,543,658 discloses a multi-plate slipping clutch. By varying the force on the plates, the transmitted reaction torque can be controlled.

Generally speaking, rotating machinery has a torque transmission capability proportional to the rotor volume. This means the normal industrial means of increasing torque is to increase diameter, since volume increases with diameter squared. However in a given borehole the diameter is constrained and length is the only means of increasing the torque capability. This means a slipping clutch that is scalable to high torque is one that will scale with length.

Gearboxes are restricted in scalability by the difficulty of spreading the torque loading over elongated gear meshes. Loads on gear teeth are difficult to spread evenly on wide meshes and multiple gears with load balancing construction are very difficult to implement successfully.

A multi-plate clutch could in principle be scaled with length but there are difficulties with controlling large numbers of plates, and the plates can be difficult to release from engagement with one another.

According to a first aspect of the invention there is provided a borehole cutting assembly for directional cutting in a borehole, the assembly comprising an input pipe and a cutting head rotatably mounted on the input pipe such that the orientation of the cutting head relative to the input pipe can be altered to determine the direction of cutting of the borehole, a cutting tool and cutting tool motor being mounted on the cutting head to enable the cutting tool to be rotatably driven relative to the cutting head so that when the cutting tool is loaded in use the cutting head is subject to a tool reaction torque that acts to rotate the cutting head to change the orientation of the cutting head, the cutting head being rotatably mounted on the input pipe by a controlled torque coupling comprising a progressive cavity pump having a rotor and a stator each provided with drive formations arranged to define a fluid flow cavity therebetween, rotation of the rotor relative to the stator forcing fluid flow through the cavity to counteract the tool reaction torque, fluid flow control means being provided to control the flow of fluid through the cavity in use and thus to control the magnitude of the counteraction generated by the progressive cavity pump to the tool reaction torque.

In one embodiment, the rotor of the pump is secured to the input pipe, the stator of the pump being secured to the cutting head.

In another embodiment, the rotor of the pump is secured to the cutting head, the stator of the pump being secured to the input pipe.

Controlling the amount by which the tool reaction torque is counteracted may enable the orientation of the cutting head relative to the input pipe to be altered in order to steer the cutting head. This also may allow, when required, control of the speed of rotation of the input pipe relative to the cutting head for cutting ahead. Thus the flow of fluid through the progressive cavity pump may be controlled such that the cutting head orientation is in a desired direction whilst still enabling the input pipe to rotate and thus progress more easily along the borehole.

The use of a progressive cavity pump as a controlled torque clutch as described above advantageously enables the coupling to be used with relatively large through to relatively small input pipe diameters that would not be possible with the prior art controlled torque clutches described above.

The progressive cavity pump may comprise driving fluid inlet and outlet apertures that are not in communication with the input pipe, and which are linked in a driving direction by the fluid flow cavity and which are linked in a return direction by a return passageway formed in the rotor or stator.

The progressive cavity pump may be provided with its own source of driving fluid. The fluid may comprise any suitable driving fluid as dependent on the pump components and may comprise hydraulic oil or water for example. Water may be less prone to swelling elastomers typically used in the pump stator.

Alternatively the progressive cavity pump may comprise driving fluid inlet and outlet apertures that are in communication with the input pipe and which are linked in a driving direction by the fluid flow cavity such that fluid pumped down the input pipe charges the fluid flow cavity to power the progressive cavity pump. The fluid pumped down the input pipe may additionally serve other know purposes such as lubricating the cutting tool. In use, a portion of the fluid pumped down the input pipe may initially charge the fluid flow cavity, the remaining fluid bypassing the pump.

The driving fluid may therefore comprise a mud slurry as is well known.

Preferably the fluid flow control means comprises a valve that controls the flow of fluid into or out of the progressive cavity pump.

The valve preferably comprises two parts with respective orifices, the pump fluid output being passed through the orifices to a fluid tank, the pump drawing its input fluid from the tank thereby forming a hydraulic circuit.

Preferably one of the parts of the valve comprises a valve sleeve movably mounted on the rotor or stator of the pump and comprising a valve orifice through which driving fluid flows in use of the coupling, movement of the valve sleeve relative to the rotor or stator moving the valve orifice into or out of register with a pump orifice on the rotor or stator.

Preferably the valve sleeve is rotatably mounted on the rotor or stator of the pump.

The valve sleeve may alternatively, or additionally, be slidingly mounted on the rotor or stator. In this example, the valve sleeve may be threadingly mounted on the rotor or stator and may be connected to an actuator operative to rotate the valve sleeve along the threaded mount to move the valve orifice into or out of register with the pump orifice on the rotor or stator.

Preferably the valve sleeve is constrained to rotate with the input pipe in use of the coupling.

The other part of the valve may comprise a second valve sleeve.

Preferably the second valve sleeve is constrained to rotate with the input pipe, with some degree of relative angular positioning.

The pump orifice on the rotor or stator may comprise an inlet orifice or an outlet orifice as required.

Preferably the valve comprises biasing means operative to engage the valve sleeve and bias the valve sleeve to an open position in which the valve orifice is substantially aligned with the pump orifice.

Preferably the biasing means comprises a compliant torsional restraint which ensures the two parts of the valve move together, so that the orifices remain in register and fluid may flow through the hydraulic circuit.

Preferably the valve is operatively coupled to a variable load operative to vary the load on the valve in order to vary the position of the valve orifice relative to the pump orifice to control the flow of fluid through the pump.

The valve may comprise an electrical generator defined by permanent magnets on one of the valve and pump and electrical windings on the other of the valve and pump, movement of the valve sleeve relative to the pump generating an electrical voltage, applying a variable load to the generator causing current to flow that is used to operate the valve.

The electrical windings may be electrically connected to variable resistor means operative to apply a variable electrical load to the windings.

The electrical windings may be electrically connected to electronic control means operative to control the coupling, the electric output generated by the movement of the valve sleeve at least partially powering the electronic control means. The electric output may be sufficient to completely power the electronic control means.

The coupling is preferably therefore at least partially self-powered in that all the electrical power required by the coupling is generated by rotation of the valve sleeve relative to the rotor or stator of the pump in use.

The electrical windings may be connected to other electrical equipment comprising part of the coupling, such as measurement-while-drilling equipment, directional survey sensors or other cutting head positioning, detection or control equipment.

Preferably the coupling is further provided with a drill head position sensor. Preferably the valve is below the pump and adjacent the drill head position sensor.

The valve may be operatively coupled to an electric motor operative to vary the position of the valve orifice relative to the pump orifice to control the flow of fluid through the pump.

The electric motor may be defined by permanent magnets on one of the valve and pump and electrical windings on the other of the valve and pump, the input of electrical power to the electrical windings controlling movement of the valve sleeve relative to the pump.

The cutting tool motor may comprise a positive displacement motor. The cutting tool motor may comprise an electric motor.

According to a second aspect of the invention there is provided a controlled torque coupling for use with a directional cutting assembly for directional cutting in a borehole, the coupling comprising a progressive cavity pump having a rotor and a stator each provided with drive formations arranged to define a fluid flow cavity therebetween, fluid flow through the cavity forcing the rotor to rotate relative to the stator to counteract the tool reaction torque, one of the rotor and stator comprising a pipe connector to enable the rotor or stator to be connected to an input pipe of the directional cutting assembly, the other of the rotor and stator comprising a cutting head connector to enable the rotor or stator to be connected to a cutting head of the directional cutting assembly, the cutting head being of the type comprising a cutting tool and cutting tool motor mounted on the cutting head to enable the cutting tool to be rotatably driven relative to the cutting head so that when the cutting tool is loaded in use the cutting head is subject to a tool reaction torque that acts to rotate the cutting head to change the orientation of the cutting head, the coupling being arranged such that rotation of the rotor relative to the stator forces fluid flow through the fluid flow cavity to counteract the tool reaction torque, fluid flow control means being provided to control the flow of fluid through the fluid flow cavity in use and thus to control the magnitude of the counteraction to the tool reaction torque generated by the progressive cavity pump.

Other aspects of the present invention may include any combination of the features or limitations referred to herein.

The present invention may be carried into practice in various ways, but embodiments will now be described by way of example only with reference to the accompanying drawings in which.

Figure 2:
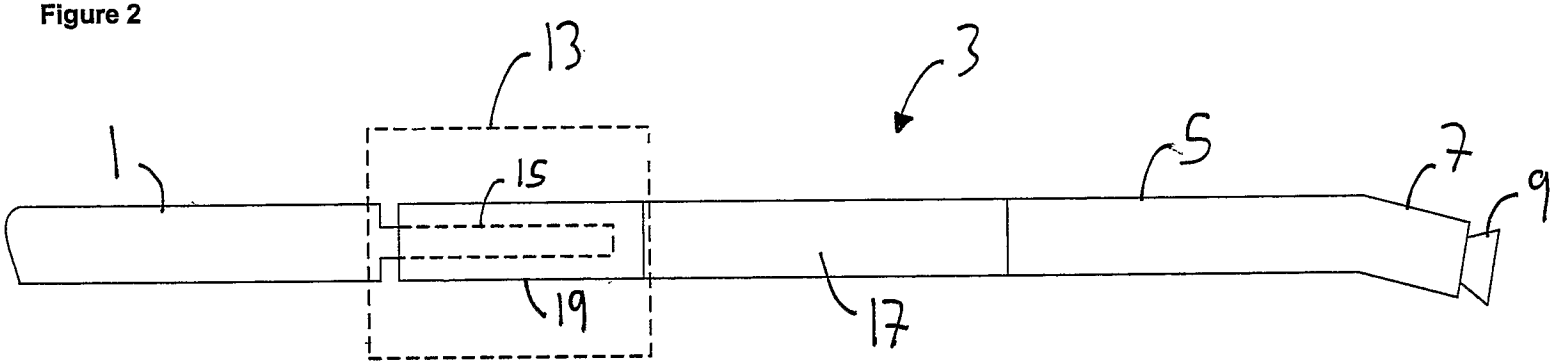
FIG. 2 is a side view of a borehole cutting assembly for direction cutting in accordance with the present invention.
Figures 4A, 4B, 4C:
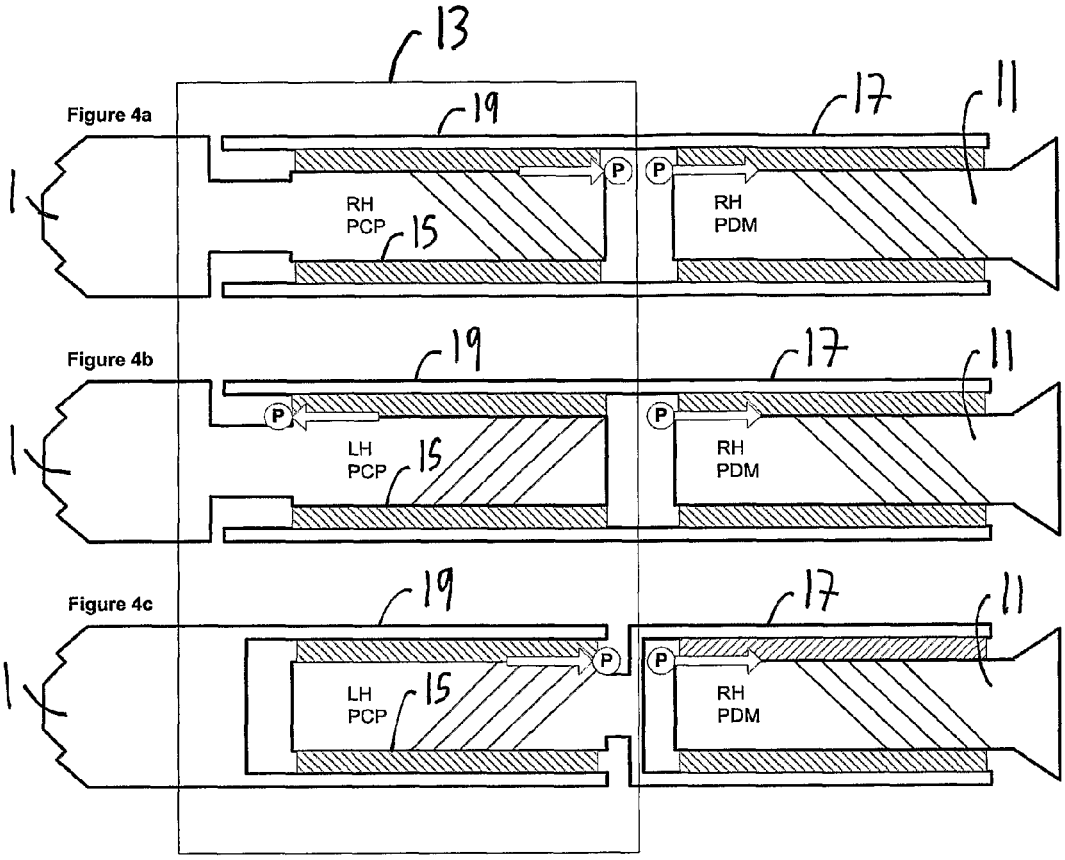
Figure 5:
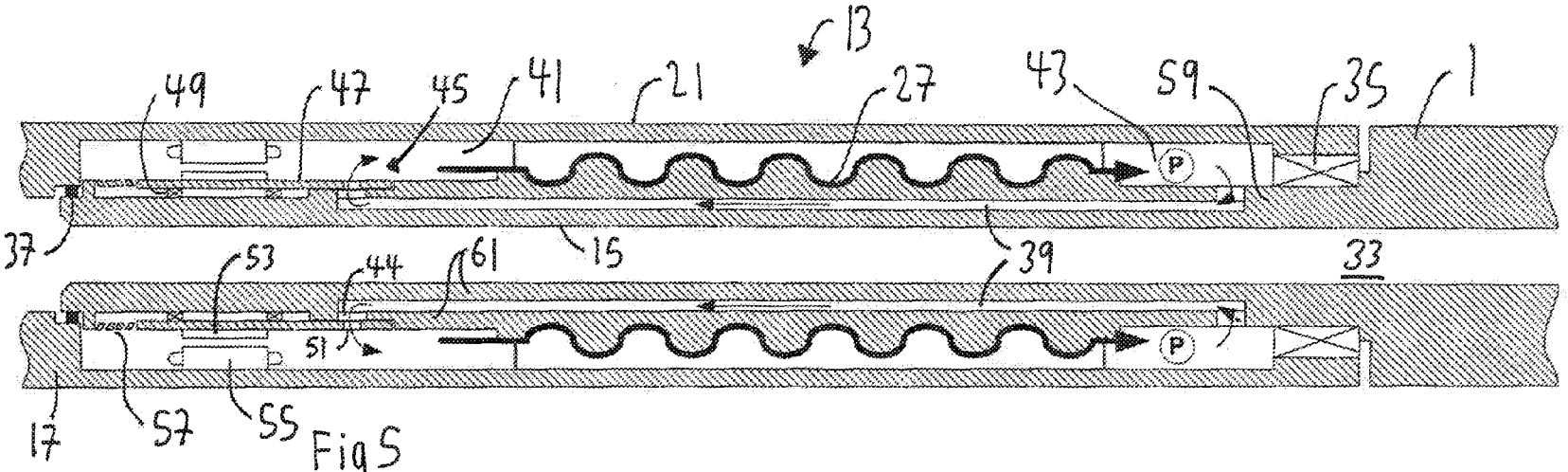

FIGS. 4*a* to 4*c* are enlarged sectional side views of three different configurations of borehole cutting assembly of FIG. 2;

FIG. 5 is an enlarged side view of the borehole cutting assembly of FIG. 4*c;*

Figure 6:
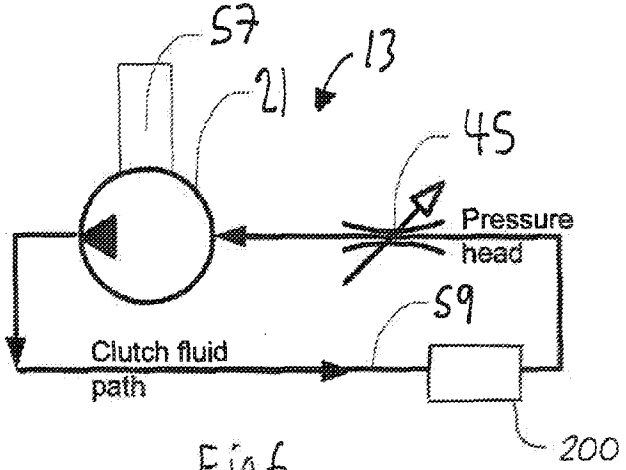
Figure 7:
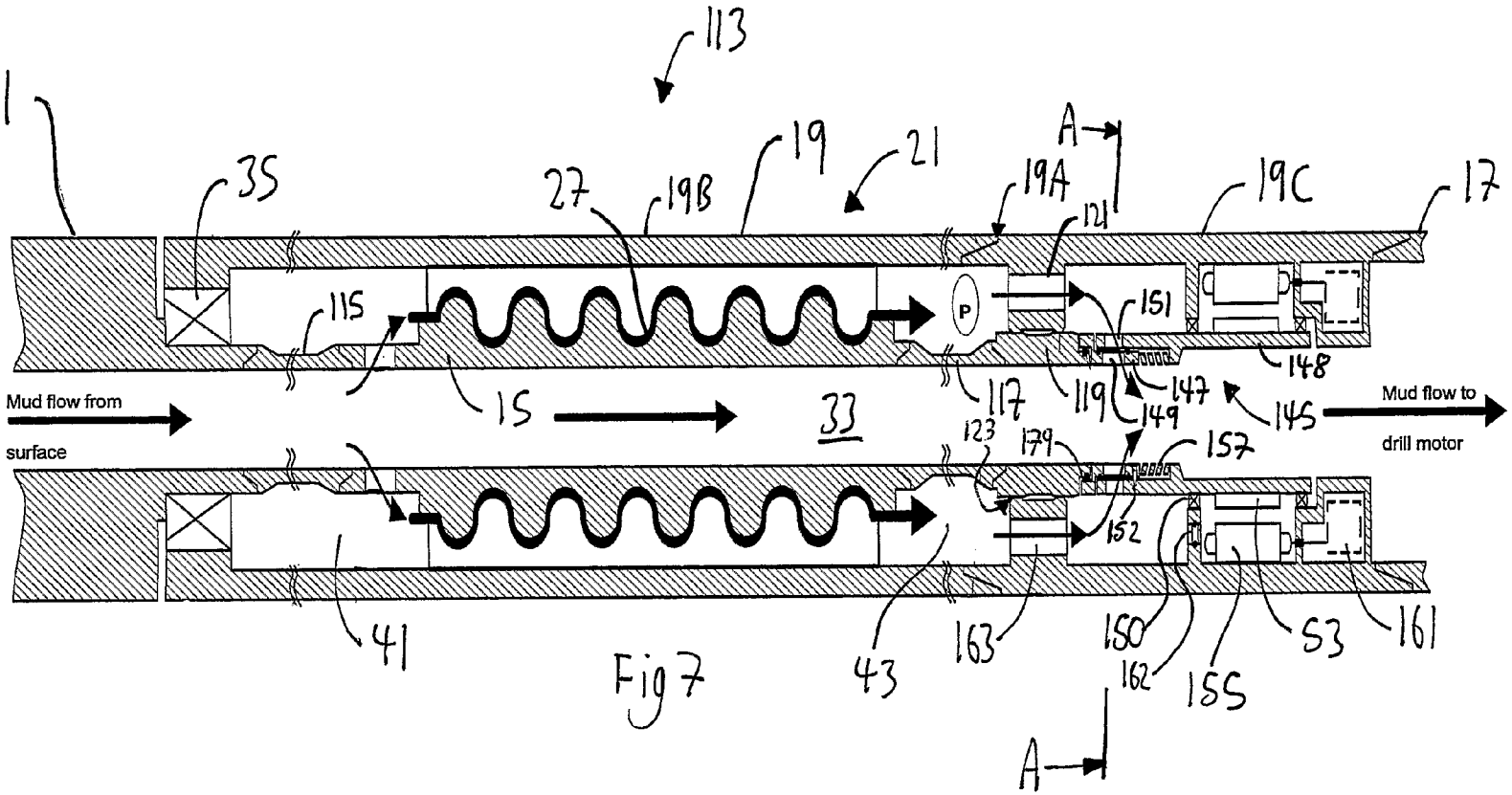
Figure 8:
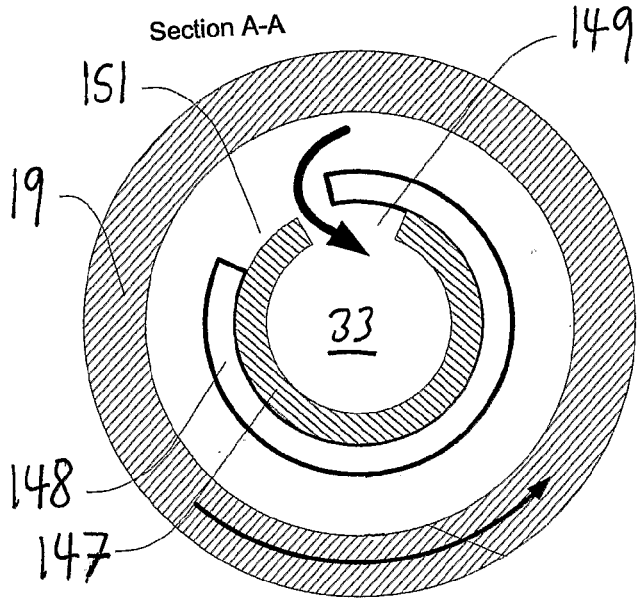
Figure 9:
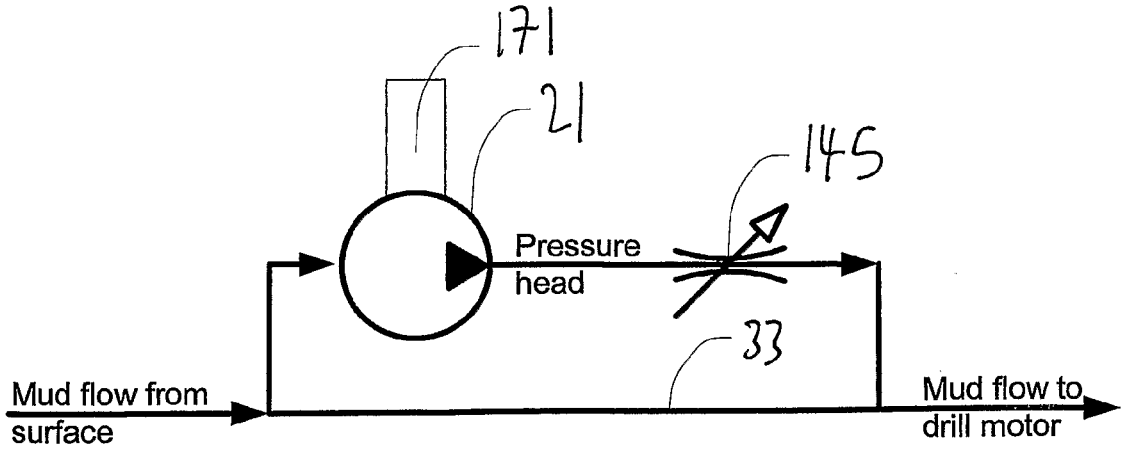
Figure 10:
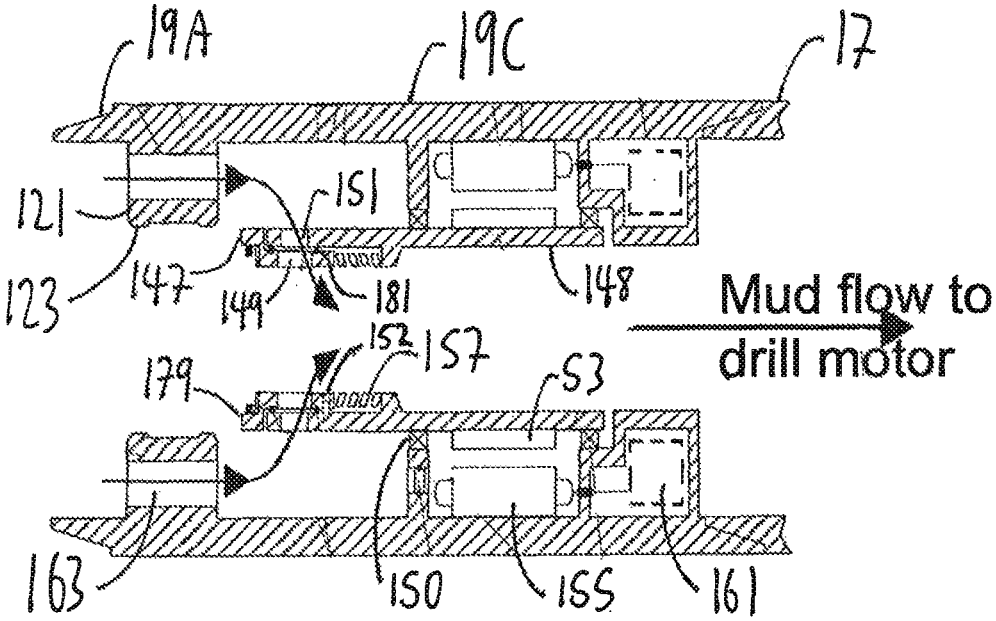
Figure 11:
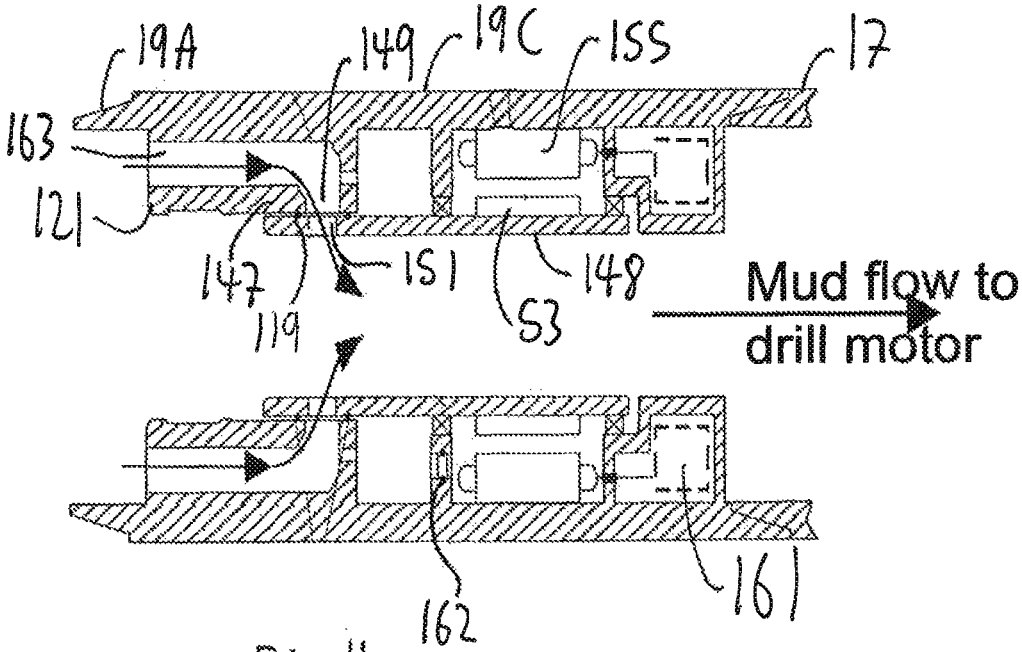

FIG. 6 is a schematic view of a hydraulic circuit forming part of the borehole cutting assembly of FIG. 5;

FIG. 7 is an enlarged side view of a modified borehole cutting assembly in accordance with the present invention;

FIG. 8 is an enlarged, sectional end view taken on line A-A of FIG. 7;

FIG. 9 is a schematic view of a hydraulic circuit forming part of the borehole cutting assembly of FIGS. 7 and 8;

FIG. 10 is an enlarged sectional side view of part of the borehole cutting assembly of FIGS. 7 to 9; and FIG. 11 is an enlarged sectional side view of part of a further modified borehole cutting assembly in accordance with the present invention.

Figure 1:
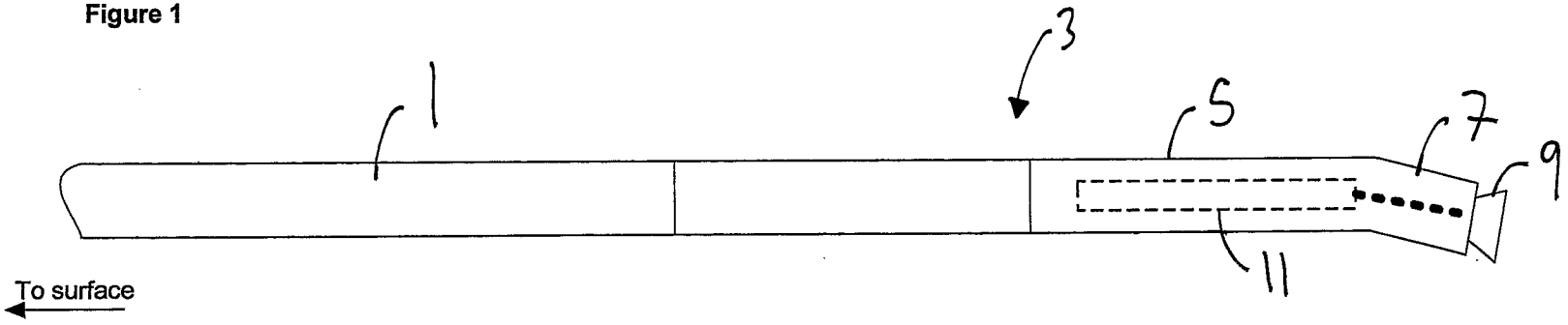
FIG. 1 is a side view of a prior art borehole cutting assembly for direction cutting.

Referring initially to FIG. 1, in a representative layout of a prior art borehole cutting assembly, an input pipe comprising drill pipe 1 is rigidly connected to a cutting tool head comprising bottom hole assembly 3 provided with an elongate housing 5 terminating in a bent housing 7 on which a cutting tool 9 is rotatably mounted. The longitudinal axis of the bent housing 7 is inclined to the longitudinal axis of the drill pipe 1. The cutting tool 9 is rotatably driven relative to the bent housing 7 by a suitable down hole cutting tool motor 11 mounted in or adjacent to the bent housing 7.

Various representative bottom hole assembly components may also be included such as measurement while drilling (MWD) directional survey sensors, non-magnetic drill collar, heavy weight drill pipe, stabilisers and logging while drilling (LWD) formation evaluation sensors such as resistivity measurement, all as are well known in the field.

Referring additionally to FIG. 2, the bottom hole assembly 3 is mounted to the lower end of drill pipe 1 via a controlled torque coupling 13 in accordance with the present invention the coupling 13 being disposed between the drill pipe 1 and bottom hole assembly 3.

The coupling 13 comprises an outer tubular housing 19 that functions as a stator rigidly connected to the upper end 17 of the bottom hole assembly 3. The coupling 13 further comprises an inner part 15 rigidly connected to the lower end of drill pipe 1 and which functions as a rotor.

In use of the coupling 13, the rigidly connected housings 5, 7, 19 collectively carry the torque reaction from cutting tool 9 up to the coupling 13 and to the drill pipe 1, apart from any friction with the borehole itself.

It will be understood that by rearrangement of the above described parts of the coupling 13, the rotor and stator can be interchanged so that the rotor 15 connects to the bottom hole assembly 3 and the stator 19 connects to the drill pipe 1.

The coupling 13 functions as a controlled torque slipping clutch between the drill pipe 1 and the bottom hole assembly 3 and so, as previously described, can regulate the amount of reaction torque resisted by the drill pipe 1 so as to perform steering and/or rotation of the cutting tool 7.

Figure 3:
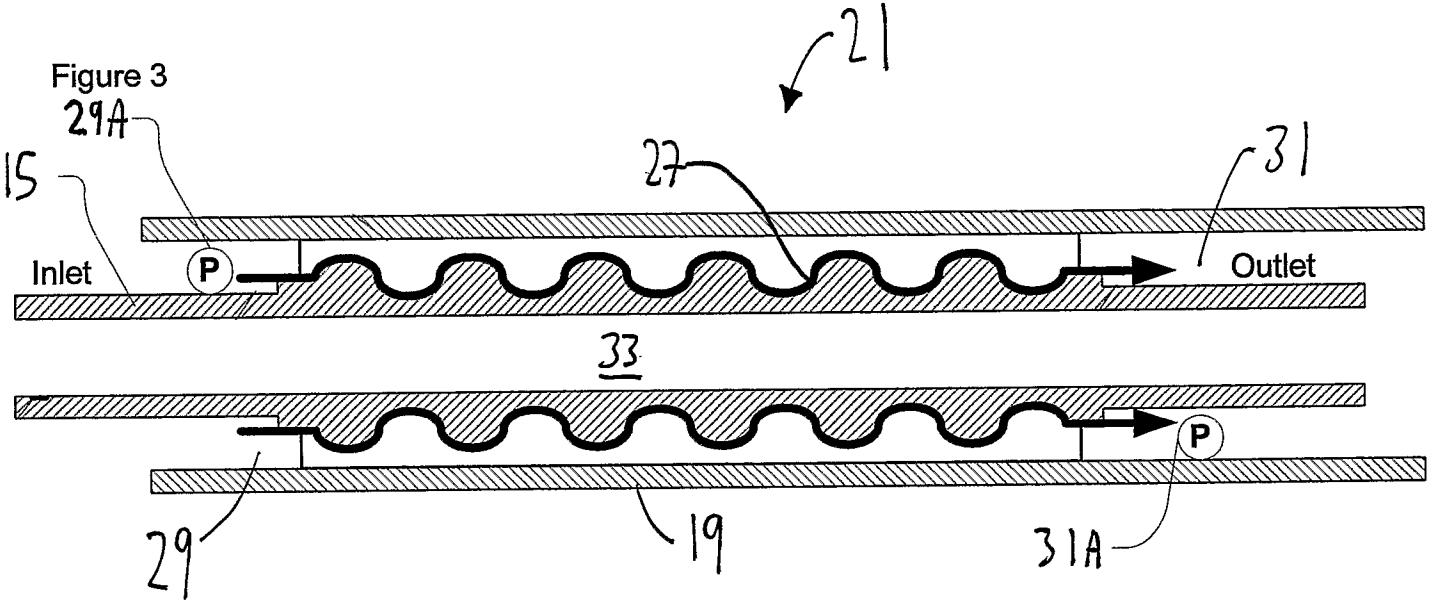
FIG. 3 is a sectional side view of a prior art progressive cavity pump or motor.

With additional reference to FIG. 3 the elements of a typical progressive cavity machine 21 are shown as an aid to describing the coupling 13. The progressive cavity machine 21 produces mechanical power from hydraulic power or vice versa. The progressive cavity machine 21 comprises a helically lobed inner rotor 15 that rotates with respect to a helically lobed radially outer stator 19. A fluid flow cavity 27 is defined between the rotor 15 and stator 19. Fluid enters the fluid flow cavity 27 via inlet 29 and discharges at outlet 31. The rotor 15 may be tubular to permit the passage of other fluid, such as cutting tool fluid, through bore 33 that extends through rotor 15.

When fluid passes through the cavity 27, a pressure differential appears between inlet 29 and outlet 31. The port at which the differential is positive will be called the head. If the differential is positive 29A at the inlet 29, this is the pressure head, hydraulic power is being applied and the rotor 15 will rotate.

The pressure is proportional to the torque demanded by the load. This is motoring. If the pressure head is positive 31A at the outlet 31, hydraulic power is being generated and torque is being applied to force the rotor 15 to rotate. This is pumping. The mechanical and hydraulic powers balance apart from inefficiencies. Thus the machine 21 may function as a motor to drive an object such as a cutting tool 7, or may function as a pump.

The rotor speed is proportional to the flow rate through the machine 21. The sense of direction is governed by the handedness of the helical lobes. In a cutting tool motor the sense is such that mud arriving from surface and discharged through the cutting tool causes the rotor to turn clockwise looking downhole. This will be termed a right handed (RH) machine. It is an easy matter to manufacture a corresponding left handed (LH) machine if required.

It is inherent in the design of progressive cavity pumps that the pump rotor 15 does not rotate concentrically to the outer stator housing 19, but rather it orbits at some small but significant offset. This means there must be some radial compliance between the rotor 15 and its connections at each end. This may be accomplished by various position means known in the field, such as tubular flexible shafts made from titanium alloy. By making the tubes sufficiently long, they can reliably accommodate the offset, which is typically less that a centimeter, while rotating. A suitable position means compensating for the rotor eccentric orbit is to use tubes as hereinbefore described would be adjacent thrust bearings at 59 and at 61 where the rotor 15 has to also conduct the returning driving fluid.

Referring additionally to FIG. 4 several examples of the use of a progressive cavity machine 21 as the controlled torque coupling 13 are shown to illustrate the directions of fluid flow, machine handedness and positive pressure differentials.

In FIG. 4*a* a RH progressive cavity machine 21 functions as a controlled torque coupling between drill pipe 1 and bottom hole assembly 3. The rotor 15 of progressive cavity machine 21, which functions as a pump, is rigidly connected to drill pipe 1 with the stator 19 being connected to bottom hole assembly 3. The stator 19 is shown as comprising a common stator with cutting tool motor 9, the rotor 117 of cutting tool motor 9 being connected to cutting tool 7.

In use, driving fluid, which may comprise a portion of the mud slurry pumped from the surface down the drill pipe 1, travels downwards with respect to the borehole in response to the relative rotation of drill pipe 1 to stator 19, and the pressure head appears at the lower end of machine 21, since in reacting torque it functions as a pump. The cutting tool fluid, which typically comprises a mud slurry pumped from surface, passes downwards into RH cutting tool motor 9 and its pressure head appears at the upper end of cutting tool motor 9. The pump driving fluid may not comprise the same fluid as is pumped down the drill pipe 1.

In FIG. 4*b* a LH progressive cavity pump 21 is used so that the driving fluid must flow upwards in response to the sense of rotation between drill pipe 101 and stator 19, with the pressure head appearing at the top of the pump 21.

In FIG. 4*c* the connections of the progressive cavity pump 21 to the drill pipe 1 and stator 19 are reversed. The progressive cavity pump 21 stator is connected to the drill pipe 1 and its rotor 15 is connected to the bottom hole assembly 3. With a LH progressive cavity pump 21 the flow through the pump 21 again travels downwards with the pressure head at the bottom of the pump 21.

In all examples, the coupling 13 controls the torque transferred between drill pipe 1 and elongate housing 5 of bottom hole assembly 3 by regulating the pressure head of the progressive cavity pump 21.

Referring additionally to FIG. 5, the LH progressive cavity pump 21 is installed in a configuration similar to that shown in FIG. 4*c*. Drill pipe 1 is rigidly connected to rotor 15 of progressive cavity pump 21, the rotor 15 comprising an elongate, hollow tube formed with through bore 33.

The drill pipe 1 is also rotatably connected to an outer stator housing 19 via a sealed bearing assembly 35. The bearings in assembly 35 may be of any type proven in wellbore cutting applications to be able to carry the required thrust loads. A lower rotary seal 37 is provided at the lower end of the coupling 13 between the rotor 15 and stator 19 which ensures all driving fluid within the coupling 13 is segregated from the standard flow of mud slurry through the coupling 13 from drill pipe 1. A suitable driving fluid is water or oil although any desired fluid may alternatively be used.

The lower end of outer stator housing 19 extends beyond rotary seal 37 and is rigidly connected to upper end 17 of bottom hole assembly 3. The outer stator housing 19 may, if required, comprise a common outer housing and/or stator with cutting tool motor 9. These components could be separate but rigidly torsionally connected to transmit torque from one to the other.

The rotor 15 of progressive cavity pump 21 in this example is modified to define an annular, internal passageway 39 that extends in a direction parallel to the longitudinal axis of the coupling 13, and through which the driving fluid circulates in a closed loop. This passageway 39 can for example be formed by an interior tubular liner. An upper end of the passageway 39 is provided with a radially directed pump inlet 41 and the lower end of the passageway 39 is formed with a radially directed pump outlet 43.

A valve indicated generally at 45 is provided at the lower end of rotor 15 between the internal passageway 39 and the rotary seal 37. The valve 45 is adjacent the cutting head and is operative to restrict the outlet 43. The valve 45 could alternatively be positioned adjacent drill pipe 1 and/or to restrict inlet 41.

The valve 45 comprises a tubular sleeve 47 rotatably mounted on rotor 15 by suitable bearings 49. The sleeve 47 is provided with a valve orifice 51 the angular position of which relative to outlet 43 can be altered by rotation of the sleeve 47 relative to rotor 15. Thus the sleeve 47 functions as a valve by controlling the degree of opening or closing of the outlet 43, that is, the degree to which orifice 51 is in register with pump outlet 43.

The sleeve 47 extends in a longitudinal direction away from pump outlet 43 to become the rotor of a permanent magnet generator, and carries permanent magnets 53. A generator stator 55 is fixedly mounted to the inside of outer stator housing 19 and comprises an electrical winding which is prevented from rotation in the housing 19 by a key or other locking means. Of course the generator rotor and stator may be mounted the opposite way around with the electrical windings on the rotor 15 and the permanent magnets 53 on the stator 19.

Biasing means comprising a compliant torsional constraint 57, such as a torsion spring, ensures the valve sleeve's orifice 51 is aligned with the outlet 43 on the pump rotor 15, so as to be biased to a substantially fully overlapped position in which there is minimum restriction to flow through the pump 21.

There may be several orifices around the circumference of the valve parts, and they may be arranged between opposed transverse faces of the sleeve 47 and pump rotor 15, rather than, as shown in FIG. 5, in the walls of the coaxial parts.

With reference additionally to FIG. 6, the hydraulic circuit of the coupling 13 of FIG. 5 shows the closed driving fluid path 59, the pump 21, and the valve 45, and a tank 200. The relative rotation of drill pipe 1 and outer stator housing 19 is the mechanical input 57 to the pump 21. This relative rotation is caused by the reaction torque between the rotating cutting tool 7 and the drill pipe 1 in use.

Segregating the driving fluid from the drilling mud has the advantage that it is clean and so less arduous on the valve 45 and pump elements of the coupling 13, and it enables a wide choice of valve types, including piloted proportional valves of well known type. It has the disadvantage that there has to be a means of permitting expansion of the oil as it heats up. Commonly known as a compensator this is a movable, flexible or porous barrier between mud and oil. In view of the volume of oil contained in the progressive cavity pump 21 and its hydraulic circuit, the absorbed power and the normal high temperatures downhole compared to surface, the compensator may have to allow for a large expansion.

The operation of the control valve 45 as a generator will now be described.

The pump outlet orifice 44 rotates with the progressive cavity pump rotor 15 and the orifice 51 on the sleeve 47. Varying the overlap of the orifices 44, 51 to a greater or lesser extent respectively reduces or increases the resistance to flow of the driving fluid and hence the torque transferred by the coupling 13 from the bottom hole assembly 3 to the drill pipe 1.

In the first instance the sleeve 47 rotates at the same speed as the rotor 15, as is ensured by compliant torsional restraint 57. Preferably the restraint 57 serves to bias the orifices 44, 51 to a position where they are overlapped sufficiently for the coupling 13 to turn freely. In this way when the drill pipe 1 first turns, it meets no resistance and there is relative motion between the drill pipe 1 and outer stator housing 19. This relative motion and the presence of the restraint 57 causes the sleeve 47 to turn with the rotor 15.

The magnets 53 of the rotating sleeve 47 thus rotate relative to the electrical windings on stator 19. This generates a voltage which can be connected to an electrical load such as an electronically switched resistor. This causes a torque to be applied to the sleeve 47 against the resistance of the torsional restrain 57, and the sleeve 47 changes its angular position with respect to the rotor 15, whilst still rotating together with the rotor 15. By sliding back in this way, the orifices 43, 51 are moved out of alignment such that the valve 45 is closed and the torque transmitted by the progressive cavity pump 21 is increased. By varying the duty cycle of the time the resistor load is connected, the generator torque and hence the valve opening may be regulated.

By taking electrical power from the valve 45 as a generator via a switched resistor load, a torque is demanded from its rotor. Being connected to the second part of the control valve 45, that is, the stator housing 19 in this example, this forces the second part to move relative to the sleeve 47 against the resistance of the compliant torsional constraint 57, so reducing the overlap of their corresponding orifices 43, 51. This increases the resistance to flow in the hydraulic circuit, thereby increasing the coupling torque.

The use of the generator to produce torque on the second part of the rotating control valve 45 is in itself a slipping clutch. In this form the coupling 13 may be considered to be a two-stage slipping clutch, a small one to control the valve that controls the large one steering the cutting head 7.

When steering, rotor 15 turns with the drill pipe 1. The housing 19 is intended to be controlled to be non-rotating but with the bend of bent housing 5 pointing in the desired direction. Since the drill pipe 1 is rotating at a certain speed, such as 60 rpm clockwise looking down hole, and is resisting the reaction torque via the coupling 13, it is transferring mechanical power to the coupling 13, torque times speed. Since the housing 19 is carrying torque but is not turning, it is not transferring mechanical power from the coupling 13. The coupling 13 therefore is absorbing power which is, for example, converted to heat in its driving fluid and transferred to the surroundings.

When the coupling 13 increases its torque coupling so as to force slow rotation of the bent housing 5 for drilling ahead, such as at 20 rpm clockwise looking down hole, power is transferred into the housing 19, at the same torque as the drill pipe 1 is resisting but at a lesser speed. The controlled torque coupling 13 absorbs the power corresponding to the relative speeds times the torque transferred. Eventually if the coupling 13 is made effectively rigid the torque is transferred but there is no relative speed across the coupling 13 and it absorbs no power.

In summary, the coupling 13 functions as a controlled torque clutch which only has to absorb power to perform its roles of steering and drilling ahead.

As just described, by choosing to keep the bottom hole assembly 3 turning slowly when drilling ahead, power must be absorbed by the coupling 13. This is always the case when steering. There is relative motion between rotor 19 and housing 3 when steering and as just described some relative motion can be arranged when drilling ahead. Therefore, in both modes of operation, the generator is always excited. Some of its power may be used to operate its electronic control means and therefore provide a self-powered piece of equipment, and a possible source of power for other equipment in the bottom hole assembly 3. For purposes of logging events when the drill pipe 1 is not rotating, a small battery pack may still be required.

The embodiment in FIG. 5 has the advantage that the driving fluid is clean, which is desirable for valve design. It has the several disadvantages that special provision for oil circulation, expansion and sealing must be made.

Referring to FIGS. 7 to 10 a modified controlled torque coupling 113 uses the same hydraulic circuit, a right handed pump and a similar rotating valve as described above with reference to coupling 13, but the driving fluid is taken from the drilling mud flow from drill pipe 1. This results in a mechanical simplification but the valve needs to be designed to cope with abrasive mud flowing through it. This can be mitigated and made practical by techniques such as ensuring close fit of the valve parts to prevent the ingress of grit, and use of hard facing and ceramic materials for wear resistance.

Drill pipe 1 is connected for rotation with the upper end of the rotor 15 of the progressive cavity pump 21 by means of a standard type of tubular flex shaft 115.

In this example, the internal passageway 39 in the rotor 15 is omitted. The driving fluid pump inlet 43 in this example opens into the internal through bore 33 of the rotor 15 through which the drilling mud slurry in pumped from drill pipe 1 in use. The pump inlet 43 thus enables the free entry of driving fluid from the mud flow from the surface.

The pump outer stator housing 19 comprises the outer housing of the coupling 113 and functions as the torque reaction transmitting housing.

The lower end of the rotor 15 is connected to a modified valve 145 by a tubular flex shaft 117 and bearing tube 119. The valve 145 in this example comprises two concentric valve sleeves 147, 148, the first sleeve 147 being connected to rotor 15 via flex shaft 117 and bearing tube 119. The first sleeve 147 is provided with a first valve orifice 149.

Bearing tube 119 runs in a bearing block 121 integral with outer stator housing 19. The bearing surfaces 123 preferably are hard faced or ceramic abrasion resistance materials. The flex shafts 115, 117 accommodate the axially offset orbiting of the pump rotor 15. The purpose of the bearing surfaces 123 is to ensure the bearing tube 119 rotates freely but concentrically to the outer stator housing 19. Upper flex shaft 115 carries all the coupling torque back to the drill pipe 1. Lower flex shaft 117 may have a thinner wall as it is only required to connect to the valve 145 and withstand the pump pressure head. Titanium alloy is a suitable material for the flex shafts 115, 117.

The second valve sleeve 148 is rotationally mounted on housing 19C using suitable bearings 150. The second valve sleeve 148 fits concentrically over part of the first valve sleeve 147 and is provided with a second valve orifice 151. Compliant torsional restraint 157 fitted between the valve sleeves 147, 148 ensures the second sleeve 148 will rotate with the first sleeve 147. As with coupling 13, the restraint 157 may be a coiled spring, but it may be made in other ways such as cantilever beam spring elements oriented axially. If the spring does not have the strength to limit the relative displacement of the valve sleeves 147, 148 during exceptional conditions, mechanical stops as in a pin and slot 152 can be used.

The second valve sleeve 148 is provided with permanent magnets 53 and an inner, adjacent part of the housing 9C is provided with coil windings 155, the magnets 53 and windings 155 comprising an electrical generator that are connected to electronics in an air filled electronics compartment 161.

In use of the coupling 113, driving fluid comprising mud slurry enters the pump 21 at pump inlet 43, travels through the fluid flow cavity 27 defined between the rotor 15 and stator 19 and discharges at the pressure head at the pump 21 lower end. The fluid travels to the valve 145 via passageways 163 formed through the bearing block 121, through the aligned valve orifices 149, 151 and back into the inner through bore 33 to rejoin the main mud stream from the surface to the cutting tool motor 9.

Referring to schematic hydraulic circuit of FIG. 9, the rotary motion between drill pipe 1 and outer stator housing 19, input at symbolic shaft 171 drives the pump 21, and the fluid flow is resisted by valve 145. Rotor through bore 33 completes the circuit. To the extent that the through bore 33 has no pressure drop in it, the circuit is identical to that in relation to coupling 13.

The mud flow to the cutting tool motor 19 is unaffected by the hydraulic circuit since all the mud arriving from surface continues on to the cutting tool motor 19 and the pressure head at the pump 21 is contained within the circuit branch between pump 21 and valve 145. In hydraulic terms the mud flow from surface is just a tank from which the pump 21 draws and returns fluid. The pump 21 and valve 145 could schematically be drawn with a single connection to the mud flow, sufficient to initially charge the pump 21 with fluid but with no further interaction.

In practice there is a slight pressure drop along the rotor through bore 33, which causes some interaction between the hydraulic circuit and the cutting tool motor 9 speed (and hence flow) fluctuations. Using standard pipe flow formulas and typical drill motor flow rates this has not been found to be a significant problem.

The coupling 113 can also be implemented with a left handed pump. The inlet openings 43 would move to the lower end and the valve 145 to the top end.

Conveniently for practical use, the outer stator housing 19 can be split with a tool joint at 19A, into parts 19B and 19C. The mechanical elements of pump rotor 15, flex shafts 115, 117 and bearing tube 119 so far described are all connected to the drill pipe 1 and so would hang together in 19B during assembly. The valve 145 can then be engaged to the rotor 15 with a simple tooth and slot arrangement 179. Seals 181 are used to prevent loss of pressure across the valve 145 due to excessive leakage. However the clearance between the valve sleeves 147, 148 is shown exaggerated for clarity. By careful manufacture with small clearances it is possible to avoid the seals 181, recognising that with a typical pressure drop of a few hundred psi and a typical flow rate of a few hundred gallons per minute, considerable leakage is permissible without significantly losing pressure.

The second valve sleeve 148 with permanent magnets 53 extends to a position adjacent coil windings 155 and thus functions as a generator rotor.

The generator in this embodiment is in an oil filled cavity, proximate to an air-filled electronics cavity 161. A piston and seal 162 allow for oil expansion.

In operation, as previously described in reference to the coupling 13, the generator is loaded electrically so as to cause first valve sleeve 147 and its orifice 149 to move relative to second valve sleeve 148 and its orifice 151, and in this way control the reaction torque.

With additional reference to FIG. 8, the first valve sleeve 148, being connected to the drill pipe 1 via the outer stator housing 19 as previously described, is stationary as considered from the point of view to drill pipe 1 and looking down borehole. The torsional compliant restraint 157 ensures the second valve sleeve 148 is biased to an open position wherein the valve orifices 149, 151 are substantially aligned, that is, in register. When steering, or when drilling ahead with some permitted rotation speed of the outer stator housing 19, the housing 19 rotates counter clockwise with respect to the valve 145. The generator, when loaded, exerts a torque acting against the restraint 157, on the second valve sleeve 148 so serving to drag valve orifices 149, 151 to a position of less overlap. This increases the resistance to flow in the pump 21 and thereby, transfers an increased reaction torque to the drill pipe 1. Thus the relative angular position of valves sleeves 147, 148 remains constant unless adjusted as described above.

It will be appreciated that a plurality of valve orifice pairs may be employed to give a better distribution of flow within the coupling 113. It will further be appreciated that the use of coaxial orifices 149, 151 and the use of joint 9A and engagement 179 are an example only and that other arrangements are possible whilst using a progressive cavity pump 21 connected to the drilling mud flow and a rotating valve 145 operated by drag action.

In the foregoing description the rotating valve 145 has been operated by applying a drag to close the valve 145. It is also possible by rearranging the valve orifices 149, 151 to operate the valve 145 by dragging to open it. In this case there must be a minimum flow, such as by a separate fixed orifice, to permit the coupling 113 to rotate on start-up to initiate the self powered generation of electronic power.

In a permanent magnet generator, the torque demanded from its shaft is proportional to the current drawn from the windings by the electrical load such as a resistor. The maximum torque that can be obtained comes when the windings are short circuited, assuming the generator design is such that the magnets do not demagnetise. The current that flows is then the ratio of the generator voltage and its internal impedance. The impedance is the vector sum of winding resistance and inductive reactance. At sufficiently high speed the reactance dominates the impedance and, as both reactance and voltage are proportional to speed, their ratio, the short-circuit current, becomes independent of speed. In this situation it is possible to have high currents and correspondingly high torques. However at low speed the winding resistance becomes important, and this sets a limit to the current and hence torque that can be extracted. This therefore poses an apparent possible limitation to the use of a generator as the control actuator for the valve 145 in the above described coupling 13, 113, since low speeds are inherent in drilling and in particular when drilling ahead with the outer stator housing 19 turning a little below the drill pipe 1 speed. Should this limitation be realised in a practical design, it is easily overcome by the use of a speed increasing gearbox inserted between and the first valve sleeve 148 and the permanent magnets 53. Such a gearbox design is straightforward as the control torques are only on the order of a few tens of Newton-meters, allowing for practical difficulties like flow forces through the orifices, seal friction and binding of the valve parts. The gearbox is subject to dynamic control forces but not the thousands of Newton meters and jarring of the reaction torque that the main slipping clutch must handle.

As already described the use of a generator to load the pump 21 has an additional benefit that a portion of its electrical output may be used to power the electronics. However the implementation of the rotating valve 45, 145 may use any means of applying control torque to it. If for example the generator was replaced by a friction plate clutch and a powered actuator, the clutch friction would serve to drag the valve orifices 149, 151 into the desired relative position. This involves a separate source of power, which is undesirable as it requires a mud turbine generator elsewhere in the system since the power drain is likely to be too high for practicable down hole battery packs.

If a separate source of power is available then another means of controlling the slipping clutch in the hydraulic circuit is to implement a motorised valve whereby an external source of power is provided to open and close the valve as required. The valve 145 no longer needs to rotate.

With reference to FIG. 11 the coupling 113 has the following changes. First the bearing tube 119 is the same except the engagement feature 179 and seal 181 is removed. This tube 119 then just rotates concentrically, and may be sealed with a rotary seal in the bearing face if it should leak too much.

The first valve sleeve 147 is conveniently made part of an extended bearing block 121, where passageway 163 is extended to create a first orifice 149. Second valve sleeve 148 is simplified so carries only orifice 151. Seals 191 may be fitted if needed to prevent excessive leakage. Permanent magnets 53 and coil windings 155 on the inner surface of bearing tube 119 comprise a permanent magnet motor, with changes if necessary to incorporate a step-down gearbox looking from the motor to the valve 145. In principle the motor and possible gearbox can be exactly the same as, or similar to, the generator and possible gearbox, with the difference that the generator creates torque demand on the rotating valve 145 by absorbing power into a simple switched resistive load, whereas the motor supplies torque to the non-rotating valve 145 by drawing power from a large separate power source, with its concomitant complexity. The separate power source may comprise a turbine generator situated in the bottom hole assembly 3 in the flow of mud slurry from surface.

The electronic control means comprising the electronic control loop used to control the coupling 13, 113, may be made by known circuit analogue and/or digital and control techniques and with known orientation sensors. The measured instantaneous absolute orientation of the cutting tool direction (so-called tool-face) is continuously compared to an absolute reference. The measurement and reference may be obtained by direct communication with widely known measurement while drilling equipment in the bottom hole assembly 3. Alternatively the reference may be pre-stored in the circuitry memory before drilling begins. Preferably however the reference is obtained directly by the coupling 13, 113 from an encoded sequence of drill-pipe speeds initiated at the surface. Similarly the measurement of orientation may obtained by known sensors internal to the circuitry such as accelerometers. By using such surface signalling and internal sensors, the coupling 13, 113 becomes a stand-alone unit that may easily be incorporated in any steerable drilling system.

When steering ahead there is no fixed angle to steer at. It is required instead to ensure the outer stator housing 19 turns at a nominally steady speed relative to the drill pipe 1. While in principle this can be done using the signals from the angle sensors during rotation, it can also be accomplished by directly measuring the angle and hence its rate of change, between housing 19 and drill pipe 1. A suitable method for this is a shaft angle encoder such as a resolver, mounted in the generator or motor cavity between rotor 15 and housing 19.

In the coupling 13, 113 described above, the main steering torque converter, a slipping clutch provided by a progressive cavity pump 21, is regulated by a rotating valve 45, 145 whose orifice opening is in turn controlled by the drag of an electrical torque converter.

A portion of the electrical power from the generator may be used to power electronic circuitry. This electronic circuitry is used in conjunction with known orientation sensors to measure the orientation of the bottom hole assembly 3, and to compare this with a predetermined or communicated reference direction. Then by varying the generator load on the valve 45, 145, to increase or decrease the valve opening as needed to balance the reaction torque, the bent housing 5 may be held in the required direction, or permitted to rotate relatively slowly for drilling ahead. Communication may be by known means such as wires to the measurement-while-drilling circuitry in the bottom hole assembly 3, or preferably for the goal of standalone installation by, for example, detecting an encoded sequence of different drill-pipe speeds.

The foregoing has described embodiments of the coupling 13, 113 in which a progressive cavity pump 21 matched to the cutting tool motor size is used in conjunction with a rotating control valve 45 and controllably loaded generator to steer and drill ahead while the drill pipe 1 is rotating. The generator thus renders the coupling 13 capable of being self-powered.

Throughout the above description reference has been made to drilling and drill pipe 1. These are intended to be generic references and it is intended that the coupling 13, 113 be used with any desired cutting tool examples of which include a drill bit, reaming tool, or coring tool.

The electronic control means comprising the required electronic circuitry for this is not shown as it may be packaged and connected for downhole use by a large variety of well known means.

In the present coupling the progressive cavity pump 21 can be made with a relatively high torque capability, at any of the drill motor manufactured diameters. It is able inherently to keep up with advances in motor performance as have occurred in recent years due to improved materials and manufacturing quality. By loading the pump 21 to resist fluid flow through it, it can in principle be used as the primary slipping clutch element in all steerable drilling applications.

Control of the valve 45, 145 makes use of the fact that whether steering or drilling ahead there is relative motion between the input pipe 1 and the cutting head 5 on which the cutting tool 7 is mounted. The input pipe 1 is always turning, for example at 60 rpm, but when steering, the cutting head 5 will be non-rotating. When drilling ahead it the cutting head 5 is also turning but it is acceptable for this to be at a lesser speed than the input pipe 1, such as 20 rpm, so that a difference in rotational velocity appears between them.

It will be appreciated that the term 'valve orifice' is used broadly to mean any flow port, bore, or gap in a valve assembly through which fluid can flow, and which can be opened or restricted to control the flow of fluid.

The invention claimed is:

1. A borehole cutting assembly for directional cutting in a borehole, the assembly comprising an input pipe and a cutting head rotatably mounted on the input pipe such that the orientation of the cutting head relative to the input pipe can be altered to determine the direction of cutting of the borehole, the cutting head comprising a cutting tool and a cutting tool motor operable to rotate the cutting tool relative to the input pipe so that when the cutting tool is loaded in use the cutting head is subject to a tool reaction torque that acts to rotate the cutting head to change the orientation of the cutting head, the cutting head being rotatably mounted on the input pipe by a controlled torque coupling comprising a progressive cavity pump having a rotor and a stator each provided with drive formations arranged to define a fluid flow cavity therebetween, rotation of the rotor relative to the stator forcing fluid flow through the cavity to counteract the tool reaction torque, fluid flow control means being provided to control the flow of fluid through the cavity in use and thus to control the magnitude of the counteraction generated by the progressive cavity pump to the tool reaction torque, the fluid flow control means comprising a hydraulic circuit comprising the progressive cavity pump, a valve and a tank from which the progressive cavity pump draws and returns fluid, the valve being arranged in the hydraulic circuit in series with the progressive cavity pump such that a pressure head generated at the progressive cavity pump in use is contained within the circuit branch between the progressive cavity pump and the valve.

2. The assembly of claim 1 wherein the rotor of the pump is secured to the input pipe, the stator of the pump being secured to the cutting head.

3. The assembly of claim 1 the rotor of the pump is secured to the cutting head, the stator of the pump being secured to the input pipe.

4. The assembly of claim 1 wherein the progressive cavity pump comprises driving fluid inlet and outlet apertures that are not in communication with the input pipe, and which are linked in a driving direction by the fluid flow cavity and which are linked in a return direction by a return passageway formed in the rotor or stator.

5. The assembly of claim 4 wherein the progressive cavity pump is provided with its own source of driving fluid.

6. The assembly of claim 4 wherein the driving fluid comprises hydraulic oil.

7. The assembly of claim 4 wherein the driving fluid comprises water.

8. The assembly of claim 1 wherein the progressive cavity pump comprises driving fluid inlet and outlet apertures that are in communication with the input pipe and which are linked in a driving direction by the fluid flow cavity such that fluid pumped down the input pipe charges the fluid flow cavity to power the progressive cavity pump.

9. The assembly of claim 8 wherein the driving fluid comprises a mud slurry.

10. The assembly of claim 1 wherein the fluid flow control means comprises a valve that controls the flow of fluid into or out of the progressive cavity pump.

11. The assembly of claim 10 wherein the valve comprises two parts with respective orifices, the pump fluid output being passed through the orifices to a fluid tank, the pump drawing its input fluid from the tank thereby forming a hydraulic circuit.

12. The assembly of claim 11 wherein one of the parts of the valve comprises a valve sleeve movably mounted on the rotor or stator of the pump and comprising a valve orifice through which driving fluid flows in use of the coupling, movement of the valve sleeve relative to the rotor or stator moving the valve orifice into or out of register with a pump orifice on the rotor or stator.

13. The assembly of claim 12 wherein the valve sleeve is rotatably mounted on the rotor or stator of the pump.

14. The assembly of claim 13 wherein the valve sleeve is constrained to rotate with the input pipe in use of the coupling.

15. The assembly of claim 12 wherein the valve sleeve is slidably mounted on the rotor or stator of the pump.

16. The assembly of claim 11 wherein the other part of the valve may comprise a second valve sleeve.

17. The assembly of claim 16 wherein the second valve sleeve is constrained to rotate with the input pipe, with some degree of relative angular positioning.

18. The assembly of claim 1 wherein the pump orifice on the rotor or stator may comprise an inlet orifice.

19. The assembly of claim 1 wherein the pump orifice on the rotor or stator may comprise an outlet orifice.

20. The assembly of claim 1 wherein the valve comprises biasing means operative to engage the valve sleeve and bias the valve sleeve to an open position in which the valve orifice is substantially aligned with the pump orifice.

21. The assembly of claim 20 wherein the biasing means comprises a compliant torsional restraint which ensures the two parts of the valve move together, and biases the orifices to be in register such that fluid may flow through the hydraulic circuit.

22. The assembly of claim 20 wherein the biasing means comprises a compliant torsional restraint which ensures the two parts of the valve move together, and biases the orifices not to be register such that fluid may not flow through the hydraulic circuit.

23. The assembly of claim 10 wherein the valve is operatively coupled to a variable load operative to vary the load on the valve in order to vary the position of the valve orifice relative to the pump orifice to control the flow of fluid through the pump.

24. The assembly of claim 23 wherein the valve comprises an electric generator defined by permanent magnets on one of the valve and pump and electrical windings on the other of the valve and pump, movement of the valve sleeve relative to the pump generating an electrical voltage, applying a variable load to the generator causing current to flow that is used to operate the valve.

25. The assembly of claim 24 wherein the electrical windings may be electrically connected to variable resistor means operative to apply a variable electrical load to the windings.

26. The assembly of claim 24 wherein the electrical windings is electrically connected to electronic control means operative to control the coupling, the electric generator output generated by the movement of the valve sleeve at least partially powering the electronic control means.

27. The assembly of claim 26 wherein the coupling is self-powered in that all the electrical power required by the coupling is generated by rotation of the valve sleeve relative to the rotor or stator of the pump in use.

28. The assembly of claim 24 wherein the electrical windings are connected to other electrical equipment comprising part of the coupling.

29. The assembly of claim 1 wherein the coupling is further provided with a drill head position sensor.

30. The assembly of claim 29 wherein the valve is below the pump and adjacent the drill head position sensor.

31. The assembly of claim 10 wherein the valve is operatively coupled to an electric motor operative to vary the position of the valve orifice relative to the pump orifice to control the flow of fluid through the pump.

32. The assembly of claim 31 wherein the electric motor is defined by permanent magnets on one of the valve and pump and electrical windings on the other of the valve and pump, the input of electrical power to the electrical windings controlling movement of the valve sleeve relative to the pump.

33. The assembly of claim 1 wherein the cutting tool motor comprises a positive displacement motor.

34. The assembly of claim 1 wherein the cutting tool motor comprises an electric motor.

35. A controlled torque coupling for use with a directional cutting assembly for directional cutting in a borehole, the coupling comprising a progressive cavity pump having a rotor and a stator each provided with drive formations arranged to define a fluid flow cavity therebetween, fluid flow through the cavity forcing the rotor to rotate relative to the stator to counteract the tool reaction torque, one of the rotor and stator comprising a pipe connector to enable the rotor or stator to be connected to an input pipe of the directional cutting assembly, the other of the rotor and stator comprising a cutting head connector to enable the rotor or stator to be connected to a cutting head of the directional cutting assembly, the cutting head being of the type comprising a cutting tool and a cutting tool motor operable to rotate the cutting tool relative to the input pipe so that when the cutting tool is loaded in use the cutting head is subject to a tool reaction torque that acts to rotate the cutting head to change the orientation of the cutting head, the coupling being arranged such that rotation of the rotor relative to the stator forces fluid flow through the fluid flow cavity to counteract the tool reaction torque, fluid flow control means being provided to control the flow of fluid through the fluid flow cavity in use and thus to control the magnitude of the counteraction to the tool reaction torque generated by the progressive cavity pump, the fluid flow control means comprising a hydraulic circuit comprising the progressive cavity pump, a valve and a tank from which the progressive cavity pump draws and returns fluid, the valve being arranged in the hydraulic circuit in series with the progressive cavity pump such that a pressure head generated at the progressive cavity pump in use is contained within the circuit branch between the progressive cavity pump and the valve.

36. The coupling of claim 35 wherein the rotor of the pump is adapted to be secured to the input pipe, the stator of the pump being adapted to be secured to the cutting head.

37. The coupling of claim 35 wherein the rotor of the pump is adapted to be secured to the cutting head, the stator of the pump being adapted to be secured to the input pipe.

38. The coupling of claim 35 wherein the progressive cavity pump comprises driving fluid inlet and outlet apertures that are not in communication with the input pipe, and which are linked in a driving direction by the fluid flow cavity and which are linked in a return direction by a return passageway formed in the rotor or stator.

39. The coupling of claim 38 wherein the progressive cavity pump is provided with its own source of driving fluid.

40. The coupling of claim 39 wherein the driving fluid comprises hydraulic oil.

41. The coupling of claim 39 wherein the driving fluid comprises water.

42. The coupling of claim 35 wherein the progressive cavity pump comprises driving fluid inlet and outlet apertures that are in communication with the input pipe and which are linked in a driving direction by the fluid flow cavity such that fluid pumped down the input pipe charges the fluid flow cavity to power the progressive cavity pump.

43. The coupling of claim 42 wherein the driving fluid comprises a mud slurry.

44. The coupling of claim 35 wherein the fluid flow control means comprises a valve that controls the flow of fluid into or out of the progressive cavity pump.

45. The coupling of claim 44 wherein the valve comprises two parts with respective orifices, the pump fluid output being passed through the orifices to a fluid tank, the pump drawing its input fluid from the tank thereby forming a hydraulic circuit.

46. The coupling of claim 45 wherein one of the parts of the valve comprises a valve sleeve movably mounted on the rotor or stator of the pump and comprising a valve orifice through which driving fluid flows in use of the coupling, movement of the valve sleeve relative to the rotor or stator moving the valve orifice into or out of register with a pump orifice on the rotor or stator.

47. The coupling of claim 46 wherein the valve sleeve is rotatably mounted on the rotor or stator of the pump.

48. The coupling of claim 47 wherein the valve sleeve is constrained to rotate with the input pipe in use of the coupling.

49. The coupling of claim 46 wherein the valve sleeve is slidably mounted on the rotor or stator of the pump.

50. The coupling of claim 45 wherein the other part of the valve comprises a second valve sleeve.

51. The coupling of claim 50 wherein the second valve sleeve is constrained to rotate with the input pipe, with some degree of relative angular positioning.

52. The coupling of claim 35 wherein the pump orifice on the rotor or stator comprises an inlet orifice.

53. The coupling of claim 35 wherein the pump orifice on the rotor or stator comprises an outlet orifice.

54. The coupling of claim 35 wherein the valve comprises biasing means operative to engage the valve sleeve and bias the valve sleeve to an open position in which the valve orifice is substantially aligned with the pump orifice.

55. The coupling of claim 54 wherein the biasing means comprises a compliant torsional restraint which ensures the two parts of the valve move together, and biases the orifices to be in register such that fluid may flow through the hydraulic circuit.

56. The coupling of claim 54 wherein the biasing means comprises a compliant torsional restraint which ensures the two parts of the valve move together, and biases the orifices not to be register such that fluid may not flow through the hydraulic circuit.

57. The coupling of claim 44 wherein the valve is operatively coupled to a variable load operative to vary the load on the valve in order to vary the position of the valve orifice relative to the pump orifice to control the flow of fluid through the pump.

58. The coupling of claim 57 wherein the valve comprises an electric generator defined by permanent magnets on one of the valve and pump and electrical windings on the other of the valve and pump, movement of the valve sleeve relative to the pump generating an electrical voltage, applying a variable load to the generator causing current to flow that is used to operate the valve.

59. The coupling of claim 58 wherein the electrical windings may be electrically connected to variable resistor means operative to apply a variable electrical load to the windings.

60. The coupling of claim 58 wherein the electrical windings is electrically connected to electronic control means operative to control the coupling, the electric generator output generated by the movement of the valve sleeve at least partially powering the electronic control means.

61. The coupling of claim 60 wherein the coupling is self-powered in that all the electrical power required by the coupling is generated by rotation of the valve sleeve relative to the rotor or stator of the pump in use.

62. The coupling of claim 53 wherein the electrical windings are connected to other electrical equipment comprising part of the coupling.

63. The coupling of claim 35 wherein the coupling is further provided with a drill head position sensor.

64. The coupling of claim 63 wherein the valve is below the pump and adjacent the drill head position sensor.

65. The coupling of claim 44 wherein the valve is operatively coupled to an electric motor operative to vary the position of the valve orifice relative to the pump orifice to control the flow of fluid through the pump.

66. The coupling of claim 65 wherein the electric motor is defined by permanent magnets on one of the valve and pump and electrical windings on the other of the valve and pump, the input of electrical power to the electrical windings controlling movement of the valve sleeve relative to the pump.

67. The coupling of claim 35 wherein the cutting tool motor comprises a positive displacement motor.

68. The assembly of claim 35 wherein the cutting tool motor comprises an electric motor.

* * * * *